US005567197A

United States Patent [19]

Evensen

[11] Patent Number: 5,567,197

[45] **Date of Patent: *Oct. 22, 1996**

[54] APPARATUS FOR SANDING AND BUFFING WITH A ROTATING ROLLER

[76] Inventor: Kenneth Evensen, 820 Central, Roselle, Ill. 60172

[ * ] Notice: The term of this patent shall not extend beyond the expiration date of Pat. No. 5,564,971.

[21] Appl. No.: 409,863

[22] Filed: Apr. 26, 1995

Related U.S. Application Data

[63] Continuation-in-part of Ser. No. 324,806, Oct. 18, 1994, which is a continuation-in-part of Ser. No. 168,042, Dec. 15, 1993, Pat. No. 5,365,628.

[51] Int. Cl.[6] ..... B24B 23/00

[52] U.S. Cl. ..... 451/358; 451/352; 451/504; 451/506; 451/516

[58] Field of Search ..... 451/344, 350, 451/352, 358, 495, 504, 506, 507, 508, 509, 513, 514, 516, 526, 528, 538, 539

[56] References Cited

U.S. PATENT DOCUMENTS

| | | | |
|---|---|---|---|
| 1,325,937 | 12/1919 | Fox . | |
| 2,483,422 | 10/1949 | Larson | 451/506 |
| 3,688,453 | 9/1972 | Legacy et al. | 51/400 |
| 3,790,980 | 2/1974 | Sylvie | 15/23 |
| 3,793,782 | 2/1974 | Bowling | 51/170 PT |
| 4,380,092 | 4/1983 | Brothers | 15/209 |
| 4,694,616 | 9/1987 | Lindberg | 51/170 |
| 5,007,208 | 4/1991 | Garfield | 51/281 |

OTHER PUBLICATIONS

"Coated Abrasives—Modern Tool of Industry" by Coated Abrasives Manufacturers' Institute, dated 1965; pp. 46–49, 72–77.

"Scotch–Brite and Roloc Surface Conditioning Discs" by 3M Company, 1988.

"Scotch–Brite Surface Conditioning Belts" by 3M Company, 1991, pp. 1–8.

"Scotch–Brite Surface Conditioning Products" by 3M Company, 1992, pp. 1–12.

*Primary Examiner*—Bruce M. Kisliuk
*Assistant Examiner*—Eileen P. Morgan
*Attorney, Agent, or Firm*—Fitch, Even, Tabin & Flannery

[57] ABSTRACT

A soft sanding roller apparatus is provided with a soft compressible sanding sleeve and roller that allows a wide flat to form on the side of the sanding sleeve being pushed against a substrate, such as a piece of wood. The preferred sleeve is backed by a soft deformable layer, such as a soft foam layer, which allows the sanding sleeve to conform to the surface of the substrate without chattering or digging into the substrate. The sleeve has a bore diameter smaller than the uncompressed diameter of the soft foam layer so that the foam layer exerts an even force on the cylindrical sleeve to retain its cylindrical shape. The sleeve is driven by a connection such as a one-way clutch between the sanding sleeve and the foam layer on the roller. The roller is rotated in one direction by a motor to do sanding with the one-way clutch driving the sleeve. The sleeve is removed by turning it in a direction opposite to the sanding direction and pulling it axially against the force from the compressed foam layer.

6 Claims, 14 Drawing Sheets

APPARATUS FOR SANDING AND BUFFING WITH A ROTATING ROLLER

This application is a continuation-in-part of application Ser. No. 08/324,806, filed Oct. 18, 1994, pending, which in turn is a continuation-in-part of application Ser. No. 168,042, filed Dec. 15, 1993, now U.S. Pat. No. 5,365,628.

BACKGROUND OF THE INVENTION

This invention relates to methods of and apparatus for sanding wood and other surfaces, and more particularly, to hand-held, motor power, electric or pneumatic sanding machines having a rotating roller.

Conventional rotary disk sanders and orbital sanders are used by millworkers, refinishers, cabinet makers, etc. to sand a smooth surface on pieces of wood. Typically, the rotary or orbital wood sanders with the rotating sanding material makes slight swirl marks or scratches that cut across the wood grain, and then these swirl marks must be removed by a hand-sanding and finishing of the wood surface with the grain. The surface area of these hand-held disks is usually small. One factor in limiting the effectiveness of the sanding disk is that outer edges move at higher speeds and sometimes make deep scratches, particularly, across the grain of the wood.

A number of prior art sanding devices have been disclosed in patents such as U.S. Pat. Nos. 3,793,782; 1,325,937; 3,790,980; 4,692,958; 4,380,092; 4,177,611; 4,694,616; and 5,007,208 using various motors and rotatable rollers or the like which have not been able, for one reason or another, to provide the market with a commercially available, hand-held, motor-driven tool, These roller sanders have been unable to replace conventional belt sanders or the orbital or rotary disk sanders that have most of the wood finishing market between themselves. There is on the market a wheeled sander that has a rotating sanding roller that is wheeled linearly along the wood grain. The wheels are a limiting factor where one can use this machine. Another sander on the market is called a stroke sander and has a sanding surface about six (6) inches wide and is used with a table eight (8) to ten (10) feet in length. Typically, this stroke sander is expensive, e.g., about $3,000, relatively the cost of a hand tool sander. Another sander requiring a large area is called a wide belt sander that has a belt stretched between a pair of drums. A drive drum rotates the belt, and a platen is positioned between the upper and lower runs of the endless sanding belt and pushes down on the inner surface of the lower belt run to force the outer sanding surface against the wood to sand the same. Typically, these wide, belt sanders have tables two (2) feet to five (5) feet in width and cost, for the smallest size, about $6,000. Manifestly, these large table sanders cannot be turned on edge to sand the faces or edges of a piece of wood, furniture or the like as can hand-held sanders. Belts on both the wide belt and stroke sander are relatively expensive.

Thus, there is a need for an improved, hand-held, inexpensive sanding tool having a rotatable roller that can be used for in-line sanding and that permits sanding without digging into the wood or other surfaces or without leaving swirl marks that are made by the commonly used, hand-held orbital or rotary sanders. Also, there is a need for a faster sanding method than is current provided with small, hand-held, rotary sanding equipment.

SUMMARY OF THE INVENTION

In accordance with the present invention, there is provided a new and improved method of and apparatus for linear sanding employing a hand-held, power-driven sander that will supplement the ubiquitous rotary and orbital, hand-held wood sanders. This is achieved by providing a soft cushion sanding of wood that conforms to and rides on the wood surface, rather than digging into the wood surface at high or low spots on the wood surface. The preferred roller is soft enough that the roller and sanding material deflect into a wider area of contact between the sanding roller and the wood surface. Harder, stiff resilient rollers of the prior art such as disclosed in U.S. Pat. No. 3,793,782 do not bend or deflect sufficiently, and the sanding roller thereon tends to jump or chatter when encountering high or low spots or too much resistance in the wood surface, and tends to dig into the wood at times. In contrast, the preferred roller is a soft, foam rubber or plastic roller that bends and deflects and rides on the wood without digging into the wood as the soft roller bends, deflects and flows over high or low spots so that there is little bouncing or chatter that causes the sanding roller to dig deeper into the wood as the hard, prior art resilient rollers will do. Because the soft, resilient, foam rubber or plastic roller and sanding sheet roller thereon deflects into a wider contact with the wood, there is provided a flat, wider area of wood sanding contact as contrast to the thinner, straight line of contact of a circular roller that is not substantially deflected. This deflected wider area and softness provides a wider sanding area than a line contact, and it also provides a flowing continuous contact area across higher and lower spots on the wood surface area. The very soft, foam rubber or plastic allows good contact with faces or sides of wood sheets, cabinets or furniture, metal and solid surfaces of Avonite or Corian®.

In order to efficiently mount a tubular sleeve, roll of sandpaper, or the like onto the foam rubber or plastic roller, it is preferred that the roller's outer, cylindrical surface and sandpaper roll's inner, cylindrical surface have a one way clutch-type of interconnection that allows the roll to be turned as the sandpaper roll is telescoped axially on the roller. As the roll is moved axially along the roller, the roll is turned in a direction reverse to the sanding direction while the foam rubber or plastic is being compressed. That is, the sanding tubular roller is being turned in a reverse direction as it is being slid axially along the roller as the sleeve is compressing the roller. When the tubular sanding roll is on the roller, and the roller is turned by the motor, the one-way clutch surfaces are engaged so that the roll does not slip relative to its driving roller. Preferably, the relaxed, diameter of the uncompressed, foam rubber or plastic layer on the roller is larger than the diameter of the hollow bore of the tubular sanding roll such that the foam rubber or plastic layer is slightly compressed in the radially inward direction by the applied sanding roll; and the compressed plastic foam applies an even, outwardly directed radial force against the inner surface of the sanding roll. This outwardly directed force maintains the sanding roll taut and conforming to the plastic, foam, roller layer as the sanding roller is deflected by forces applied thereto at the wood surface.

In some furniture sanding applications, such as the sanding of the surfaces of wooden doors, the present invention has reduced the time to about one-seventh from that needed to sand the doors with a rotary sanding disk followed by a hand removal of the cross-grain swirls. With the in-line, linear sanding roller method of the present invention, the sanding is done in line with the wood grain, instead of across the grain. Typically, the in-line sanding roller method of the present invention affords a much wider swatch, e.g., 18–20 inches, than a typical 4–6 inch diameter sanding disk. An appreciation of the operating speed and area sanding surface for the present invention can be understood from a comparison of the present invention with an orbital sander, a four-inch disk rotary sander and the illustrated embodiment of the invention using two rollers of nine-inch length and a three-inch circumference. Assume that the orbital sander sands at 10,000 rpms with a 1/32 inch diameter displacement. The sanding speed is about 0.02 miles per minute, which is calculated by the formula:

$$\left(\frac{\text{circumference} \times \text{rpms}}{12} + 5280\right)$$

If the orbital unit has 26 square inches of sanding area and a sanding speed of 0.02 miles per minute, it provides a sanding effectiveness of 0.52 square inch miles per minute. The four-inch rotary disk sander rotating at 10,000 rpms will have a sanding speed of about 2.0 miles per minute, which is 100 times faster than the orbital sander. The area of sanding for the disk sander is typically about 12.57 square inches. But because the disk sander is tilted in use, only about 5.5 square inches are effectively engaging the flat surface of its total area of 12.57 square inches. If the three-inch rollers of the present invention are rotated at 3,500 rpms, the speed is 0.53 miles per minute, which is about 26.5 times faster than the orbital sander. While the disk sander is faster at about 2.0 miles per minute it only has about 5.5 square inches; and this gives a sanding effectiveness of 2×5.5 or 11 square inch miles per minute for the disk sander. The present invention provides 31.50 inches of effective sanding, assuming that a 1.75 inch flat comes in contact with the wood and at a speed of 0.53 miles per minute. This gives an effectiveness of 16.7 square inch miles per minute. Thus, the present invention provides a substantially greater effectiveness than either the orbital disk sanders. It is, of course, relatively easy to increase the roller diameter size in the present invention to increase the width of the wood surface engaged and thereby increase the effectiveness of sanding surface covered. The real effectiveness and time benefits obtained with the present invention are often about 7 times or more faster over a rotary sander because one does not have to hand sand the cross grain scratches out with the invention as one must sand out after using the rotary sander. The soft cushioned sanding of the present invention rides with wood and does not dig into the wood as do the harder, though resilient, pads or rollers used in prior art sanding equipment.

DETAILED DESCRIPTION OF THE PREFERRED EMBODIMENT

Figure 1:
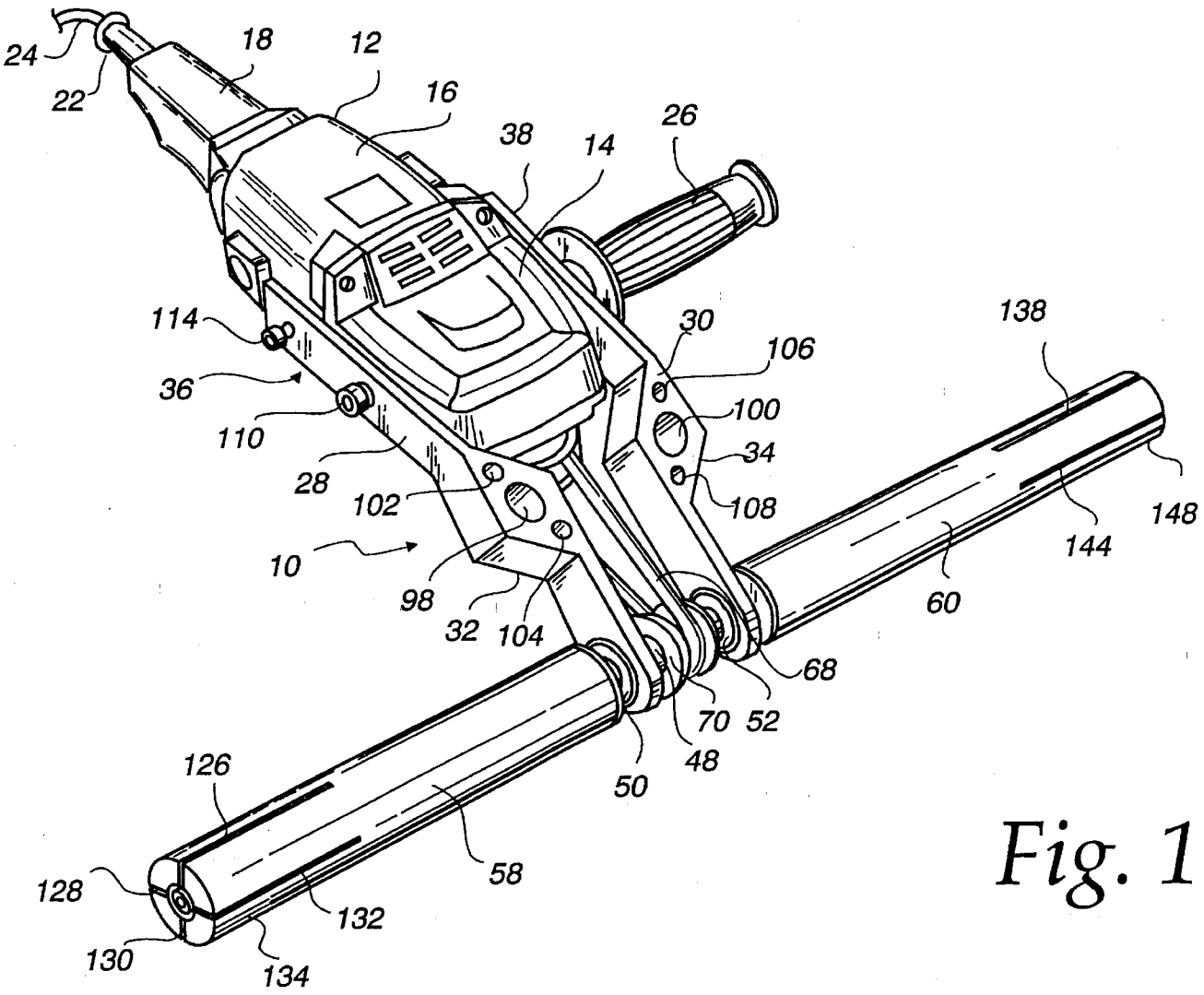
FIG. 1 is a top perspective view of one embodiment of a roller assembly, mounted on a conventional hand-held rotary disk buffing machine.

While the roller assembly of the present invention is susceptible of several constructions, there is shown in FIGS. 1–9 several embodiments of such an assembly constructed according to the teachings of the present invention with the understanding that the present disclosure is not intended to be limited to the specific construction disclosed herein and illustrated in the drawings.

Illustrated in FIG. 1 is one embodiment of a roller assembly 10 mounted on a conventional, hand-held, rotary disk buffing machine 12.

The conventional, hand-held, disk buffing machine 12 has three (3) sections: a metal motor unit 16, a plastic intermediate housing for a right angle drive unit 14, and a plastic rear handle 18. The motor is usually an electric or pneumatic motor although it can be any kind of motor. A motor (not shown) is located within the motor unit 16. An on-off trigger switch 20 is located on the rear handle 18 of the machine 12; and a strain reliever 22 and electric power cord 24, for powering the motor unit 16, extend rearwardly from the rear handle 18.

A side handle 26 is also mounted to the drive unit 14 of the machine 12. The side handle 26 extends transversely of the drive 14 and can be interchangeably mounted on either side of the drive unit 14.

The roller assembly 10 includes a first bracket 28 and a second bracket 30 which are located on either side of the drive unit 14. Each bracket 28, 30 has a distal portion 32, 34 and a proximal portion 36, 38. The proximal portions 36, 38 of the brackets 28, 30 have holes 40, 42 and 44, 46 therethrough for mounting the brackets to the machine.

An axle 48 (FIG. 5) is securely mounted transversely of the machine 12 in bearing assemblies 50, 52 which are press fit in the distal portions 32, 34 of the brackets 28, 30. Rollers 58, 60 can then be placed over the axle 48 (FIG. 6) and, as seen in FIG. 1, an attachment 62 can then be placed over the rollers 58, 60. As shown in FIG. 7, the attachment 62 is a form pad, but the attachment 62 can be sandpaper, a wire brush, or other items. Note that as shown, the rollers 58, 60 are made of aluminum; however, the rollers 58, 60 can be made of any suitable material and need not be made of aluminum.

Figure 2:
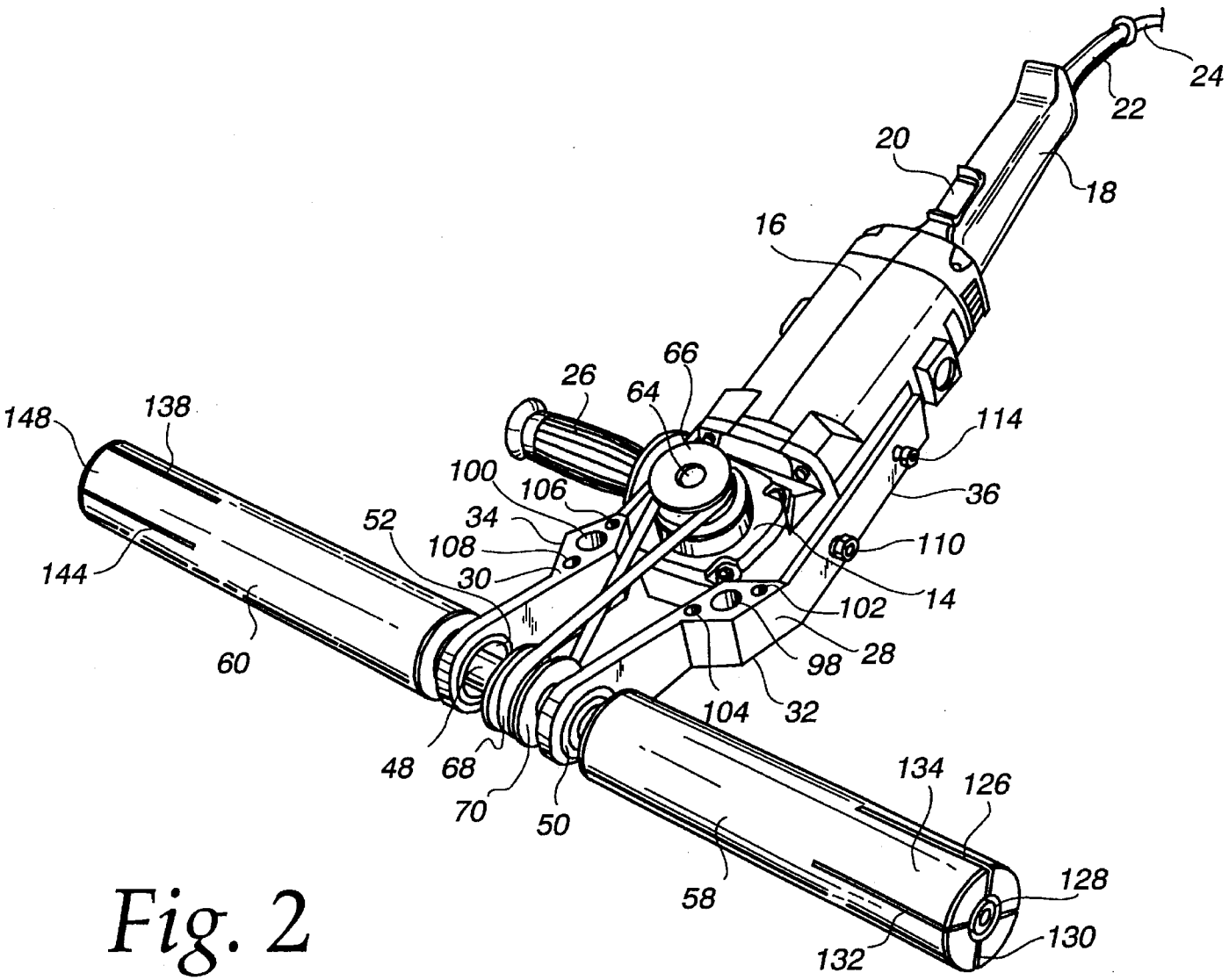
FIG. 2 is a bottom perspective view of the roller assembly of FIG. 1 mounted on the conventional hand-held rotary disk buffing machine.

As shown in FIG. 2, a driveshaft 64 extends from the motor. The driveshaft 64 rotates when the motor is powered on. The speed of rotation of the driveshaft 64 can be varied on some machines 12, such that typically the driveshaft 64 can rotate from about 1,400 to 10,000 revolutions per minute.

A first pulley 66 is mounted on the driveshaft 64 of the drive unit 14. The first pulley 66 replaces a conventional rotary disk (not shown) which is usually mounted on the driveshaft 64 of a conventional disk buffing machine 12. The first pulley 66 can be threadably attached to the driveshaft 64 in the same manner as a conventional disk would be threaded to the driveshaft 64.

A belt 68 is looped around the first pulley 66 and around a second pulley 70, which is mounted on the axle 48 of the assembly 10. The belt 68, when looped around the first pulley 66 and the second pulley 70, undergoes a quarter circle twist because the planes in which the first pulley 66 and the second pulley 70 rotate are substantially normal to each other. The belt 68 can be made of rubber, nylon or a composite of nylon and rubber.

Figure 3:
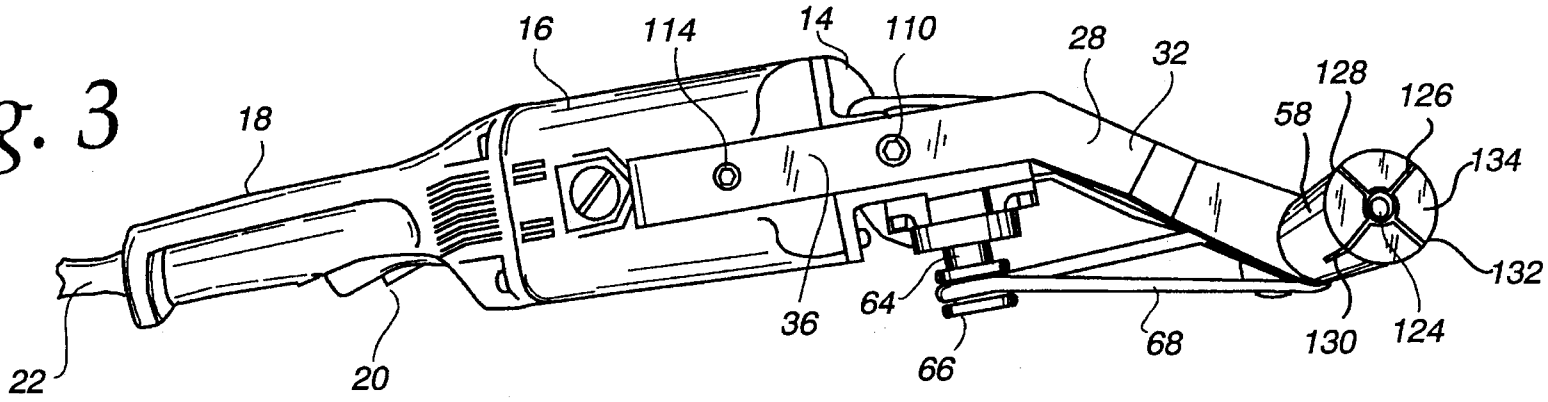
FIG. 3 is side view of the roller assembly of FIG. 1, mounted of the conventional hand-held rotary disk buffing machine.

As shown in the side view of FIG. 3, the distal portion 32 of the bracket 28 extends from the proximal portion 36 of the bracket 28 at approximately a 45° angle. The angle between the distal portion 32 and the proximal portion 36 of the bracket 28 prevents the belt 68 from hitting furniture or other objects being worked on. Adverse wear on the belt 68 is also prevented because the belt 68 cannot come into contact with the surface being worked on. The angled brackets 28, 30 also provide an approximate 90° angle between the driveshaft 64 and the belt for enhancing operation of the machine 12. A driveshaft 64 rotates when the motor is powered on. The speed of rotation of the driveshaft 64 can be varied on some machines 12, such that typically, the driveshaft 64 can rotate from about 1,400 to 10,000 revolutions per minute.

A first pulley 66 is mounted on the driveshaft 64 of the drive unit 14. The first pulley 66 replaces a conventional rotary disk (not shown) which is usually mounted on the driveshaft 64 of a conventional disk buffing machines 12. The first pulley 66 can be threadably attached to the driveshaft 64 in the same manner as a conventional disk would be threaded to the driveshaft 64.

A belt 68 is looped around the first pulley 66 and around a second pulley 70 which is mounted on the axle 48 of the assembly 10. The belt 68, when looped around the first pulley 66 and the second pulley 70, undergoes a quarter circle twist because the planes in which the first pulley 66 and the second pulley 70 rotate are substantially normal to each other. The belt 68 can be made of rubber, nylon or a composite of nylon and rubber.

As shown in the side view of FIG. 3, the distal portion 32 of the bracket 28 extends from the proximal portion 36 of the bracket 28 at approximately a 45° angle. The angle between the distal portion 32 and the proximal portion 36 of the bracket 28 helps prevent the belt 68 from hitting furniture or other objects being worked on. Adverse wear on the belt 68 is also prevented because the belt 68 cannot come into contact with the surface being worked on. The angled brackets 28, 30 also provide an approximate 90° angle between the driveshaft 64 and the belt 68 for enhancing operation of the machine 12.

Figure 4:
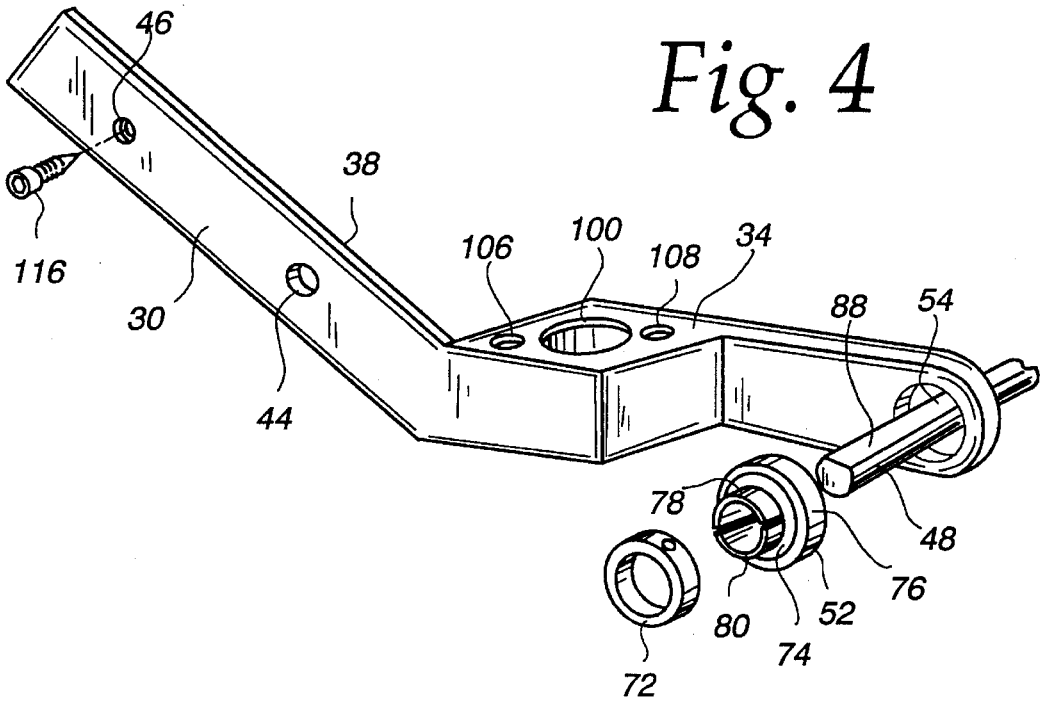
FIG. 4 is a perspective side view of one bracket of the roller assembly showing an axle and bearing assembly exploded from the bracket.

FIG. 4 shows a side view of one of the brackets 30 having a bearing assembly 52 and a collar 72 exploded from the bracket 30. The bearing assembly 52 has an inner race 74, an outer race 76 and two semi-circular portions 78, 80 extending from the inner race 74. The outer race 76 of the bearing assembly 52 is generally press-fit into a bore 54 in the distal portion 34 of the bracket 30 making the bracket 30 and bearing assembly 52 an integral unit.

The axle 48 is then placed within the inner race 74 of the bearing assembly 52 in the distal portion 34 of the bracket 30 and extends through the semi-circular extensions 78, 80 of the bearing assembly 52. The inner race 74 of the bearing assembly 52 can rotate relative to the fixed outer race 76. The other bracket 28 has a bearing assembly 50 mounted in its distal portion 32 and receives the axle 48 in the same manner.

Each collar 72, 82 slides over semi-circular extended portions 78, 80 of each bearing assembly 50, 52. Each collar 72, 82 has a threaded bore 84, 86 for receiving a set screw. The set screws in the collars 72, 82 securely fasten the axle 48 to the bearing assemblies 50, 52 by forcing one of the semi-circular extended portions 78 or 80 to engage the axle 48. Thus, the collars 72, 82, the extended portions 78, 80, the inner races 74 and the axle 48 rotate together when the axle 48 is driven by the belt 68.

Note that the axle 48 and brackets 28, 30 can be adjusted to fit different size motor units 14 by simply securing the bearing assemblies 50, 52 to the axle 48 at different points along the axle 48. Also, note that the size of the axle 48 can be varied, i.e., a longer/shorter axle 48 can be used or an axle 48 with a larger/smaller diameter can be used.

Figure 5:
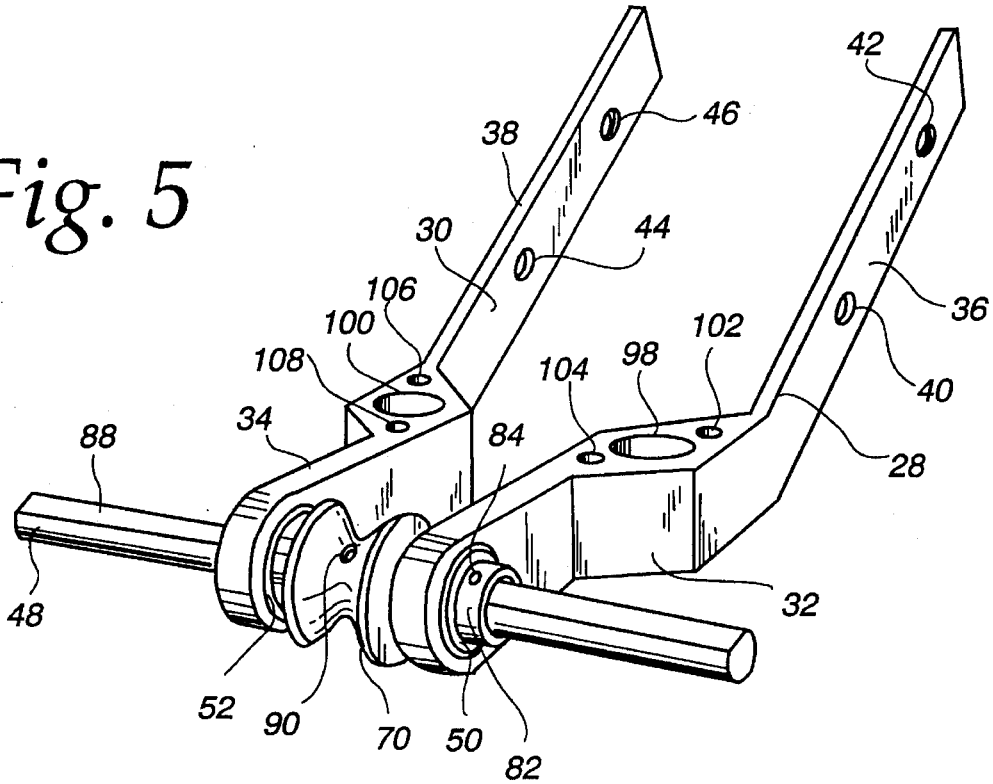
FIG. 5 is a bottom perspective view of the assembled roller assembly of FIG. 2, but not mounted to the disk buffing machine.

FIG. 5 shows a bottom perspective view of the bracket assembly 10 in which the bearing assemblies 50, 52 are press-fit into the brackets 28, 30 and in which the collars 82, 72 securely hold the axle 48 in place.

Also shown is the second pulley 70 mounted on the axle 48 between the brackets 28, 30. A flat 88 on the axle 48 can be seen here. The second pulley 70 is secured to the axle 48 by a set screw (not shown) threaded through a radial bore 90 in the pulley 70; and the flat 88 on the axle 48 provides a stop surface for holding the set screw.

Figure 11:
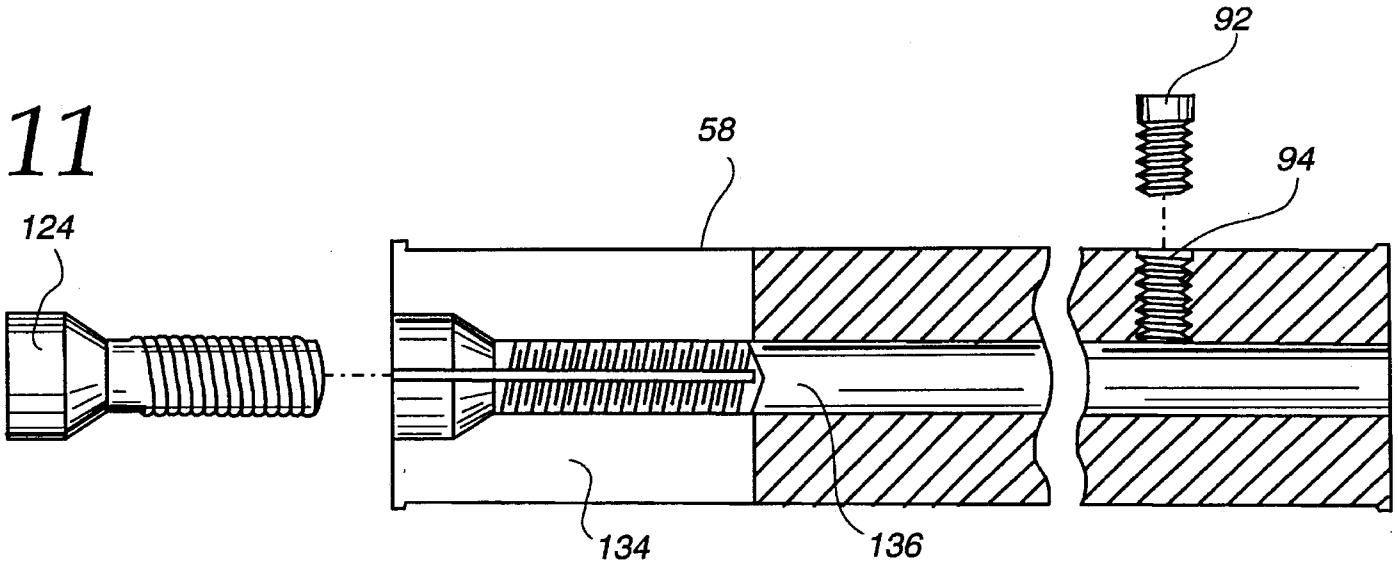
FIG. 11 is a sectional side view of the roller shown in FIG. 10 taken along line 11—11 of FIG. 10.

The set screws used in the bracket assembly 10 are flat bottom set screws similar to the set screw 92 shown in FIG. 11. Note that the second pulley 70 is positioned between the two brackets 28, 30 toward their distal portions 32, 34 and must be placed at least on the axle 48 before at least one of the brackets 28 or 30 is received or is secured to the axle 48.

Figure 6:
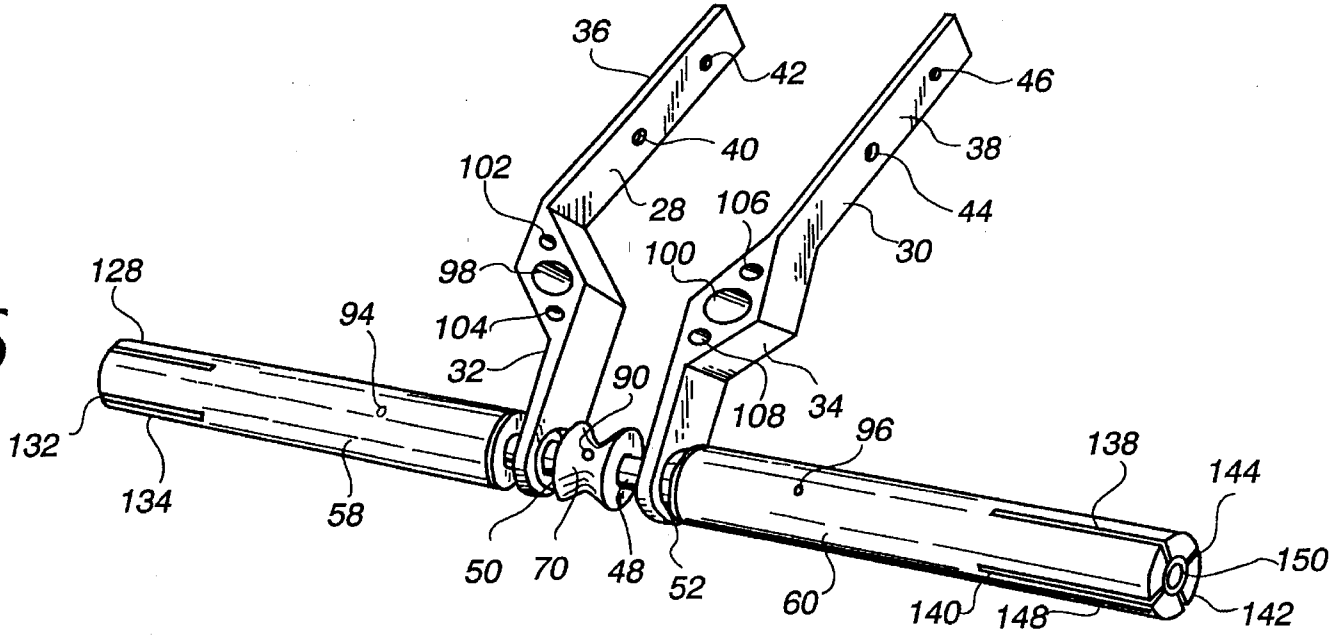
FIG. 6 is a top perspective view of the assembled roller assembly of FIG. 1, but not mounted to the disk buffing machine.
Figure 7:
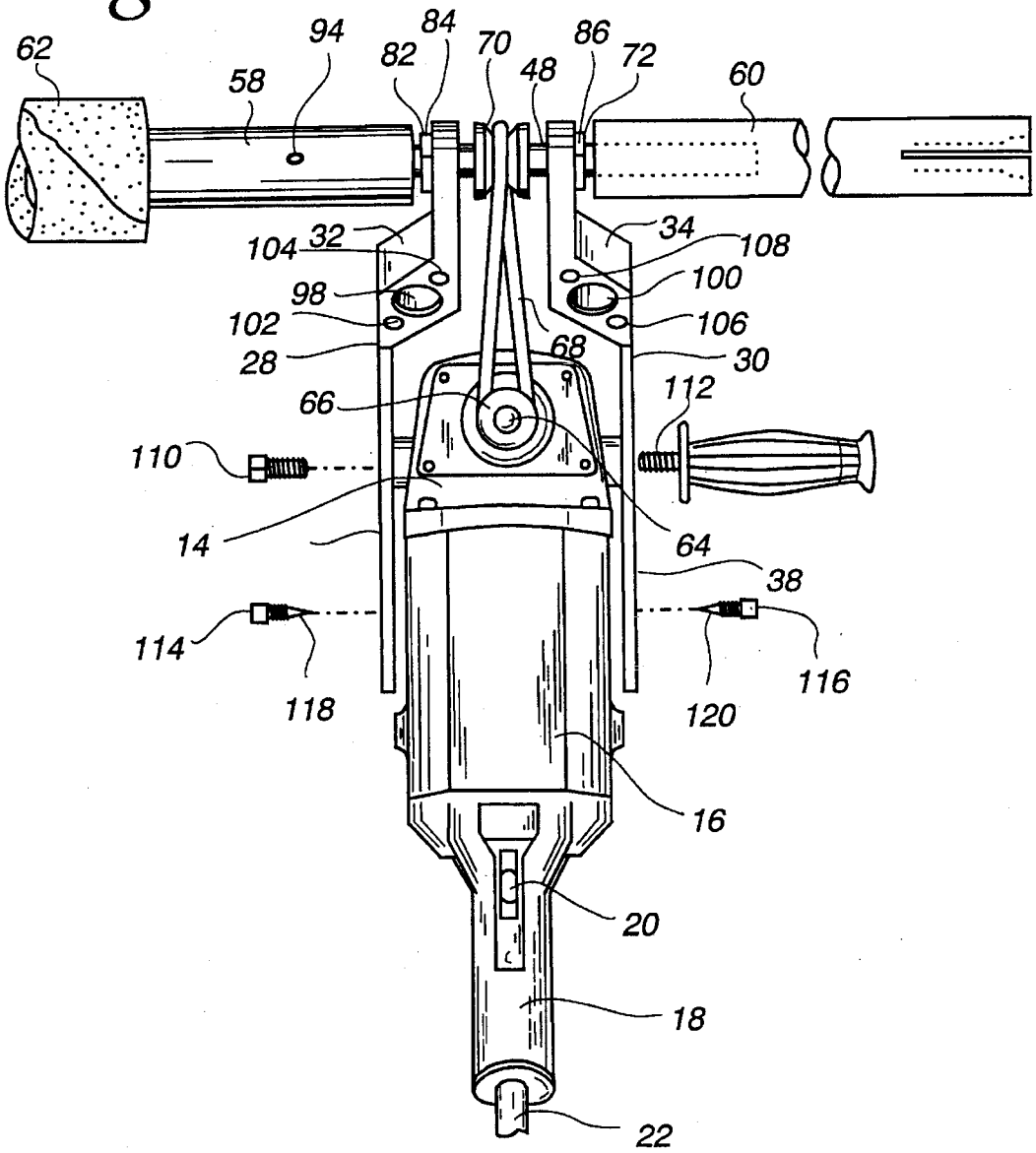
FIG. 7 is a bottom view of the roller assembly and disk buffing machine showing an exploded view of a handle, bolts and set screws used for mounting the assembly to the disk buffing machine.

As shown in FIG. 6, the rollers 58, 60 can be slidingly placed over the axle 48. The rollers 58, 60, like the second pulley 70, have small threaded radial bores 94, 96 therethrough, which receive small set screws 92 which securely hold the rollers 58, 60 to the axle 48. The set screws 92 are flat bottom set screws, as shown in FIG. 11. The flat bottom set screws 92 bear against flats 88 on the axle 48 in the same fashion as the second pulley 70 set screw. The rollers 58, 60 can be adjusted axially so that they are secured at various positions along the axle 48, so long as the set screw 92 meets the axle 48.

As shown in FIGS. 4–6, the distal portion 32, 34 of each bracket 28, 30 has one large bore 98, 100 and two small bores 102, 104 and 106, 108. These bores 98, 100, 102, 104, 106 and 108 are provided for weight relief 28, 30 as the brackets are made of aluminum and can be quite heavy. The bores 98, 100, 102, 104, 106 and 108 can also be used to mount a guard or other attachment. Note, however, that the brackets 28, 30 can be made of any suitable material and need not be made of aluminum.

A bottom view of the assembly 10 mounted on a conventional, hand-held, rotary disk buffing machine 12 is shown in FIG. 7. Here, an exploded view of the bolts 110, 112 which hold the brackets 28, 30 to the machine 12 are shown. Note that the bolts 110, 112 pass through the brackets 28, 30 and are inserted into threads (not shown) which are present on commercially available, hand-held machines 12. One of the bolts 12 can have the handle 26 attached thereto and can be placed on either side of the assembly 10.

FIG. 7 also shows pointed set screws 114, 116 which also are used in mounting the brackets 28, 30 to the machine 12. The set screws 114, 116 have tapered ends 118, 120 and are generally driven into and bear against the plastic housing 16 of the machine 12.

The combination of the bolts 110, 112 and the set screws 114, 116 securely hold the brackets 28, 30 to the machine 12. However, the brackets 28, 30 to the machine 12. However, the brackets 28, 30 can be mounted in any other suitable fashion to the machine 12.

Figure 8:
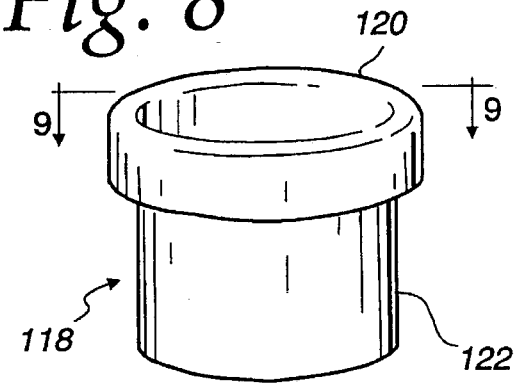
FIG. 8 is a perspective view of a plastic sleeve used to place a rolled piece of sandpaper over a foam pad on the roller.
Figure 9:
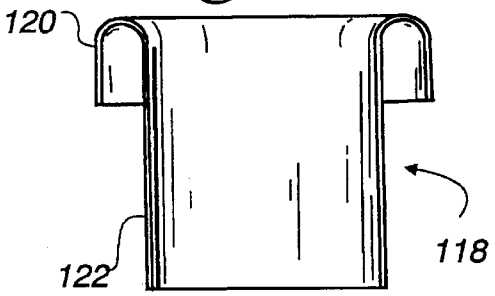
FIG. 9 is a side view of the plastic sleeve of FIG. 8 taken along line 9—9 of FIG. 8.

A tubular sleeve 118, shown in FIGS. 8 and 9, allows a user to attach sandpaper rolls over the foam pad attachments 62 on the rollers 58, 60. The sleeve 118 has a rounded end portion 120 and a hollow body portion 122. The sandpaper roll is slid on the outside of the body portion 122 of the sleeve 118. The diameter of the sleeve 118 is slightly larger than the diameter of the roller 58, 60. The sleeve 118 is then slid over the foam pad 62, and the rounded end 120 first, so as to compress the foam pad 62 and allow the rest of the sleeve 118 to slide over the pad 62. When the sleeve 118 is positioned over the roller 58, 62, the sandpaper roll is grasped and held to the foam pad 62, while the sleeve 118 is drawn off the foam pad 62 by being drawn in the same direction along the axle 48. The foam pad 62 expands slightly, to secure firmly the sandpaper roll to the foam pad 62.

Figure 10:
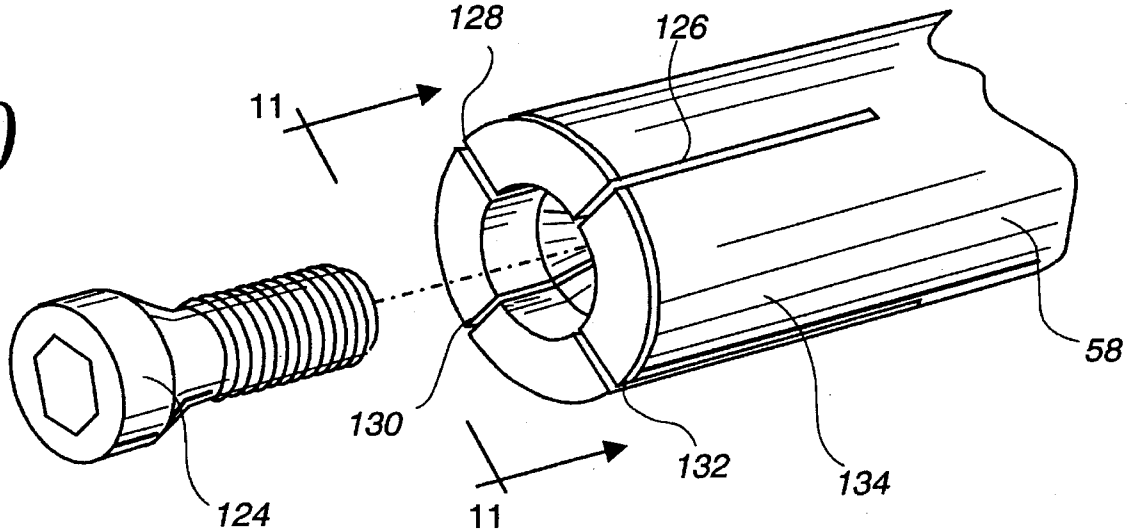
FIG. 10 is a perspective view of an end of a roller of the roller assembly shown in FIG. 1.

FIG. 10 is a perspective view of a roller 58 and a conical-shaped set screw 124. Note that the roller 58 has four equally spaced slits 126, 128, 130 and 132 which run parallel to a longitudinal axis of the roller 58 at a distal end 134 of the roller 58. The slits 126, 128, 130 and 132 allow the distal end 134 of the roller 58 to slightly expand or contract. The distal end 134 of the roller 58 contracts slightly when an attachment 62 is slid onto the roller 58.

As shown in FIG. 11, the roller 58 also has an axial bore 136 extending along the roller's longitudinal axis. The bore 136 is threaded at the distal end 134 of the roller 58. After an attachment is placed on the roller 58, the conical-shaped set screw 124 is threaded into the bore 136 and the roller 58 expands slightly, thus preventing the attachment mounted on the roller 58 from coming off during use. Note that the other roller 60 also has slits 138, 140, 142 and 144 at its distal end 148 and receives a conical-shaped set screw 150 in the same manner as the roller 58.

Referring now to FIGS. 12–18, there is disclosed other embodiments of the invention which have an improved interconnection between the roller and the roll or belt used for sanding.

Figure 12:
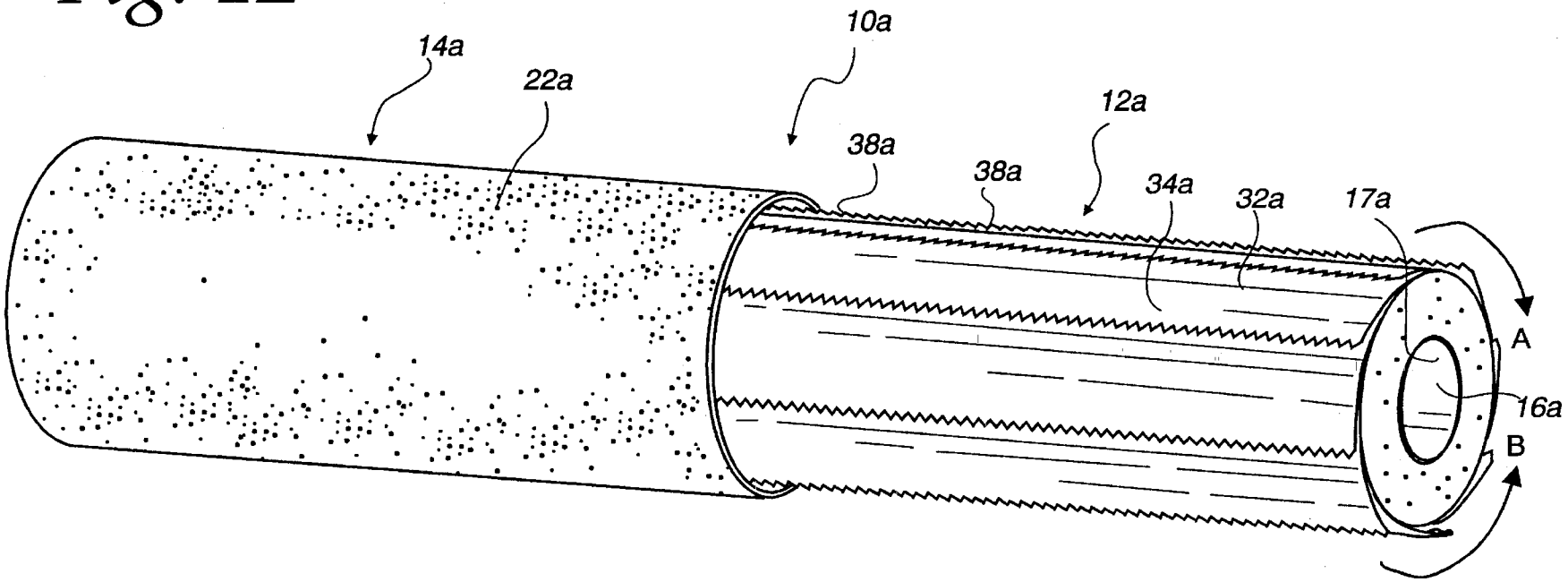
FIG. 12 is a perspective view of a partially assembled roller and belt assembly constructed according to the teachings of the present invention; and it shows a roller partially inserted into a closed loop sandpaper belt.

Referring now to FIG. 12, there is shown therein a partially assembled roller and belt assembly **10*a*. The roller and belt assembly 10*a* includes a cylindrical roller 12*a* and a closed loop belt 14*a*. The cylindrical roller 12*a* can be inserted within the closed loop belt 14*a* and, as shown in FIGS. 15, 16, 17 and 18, the roller 12*a* can be fully inserted within the belt 14*a***.

Figure 16:
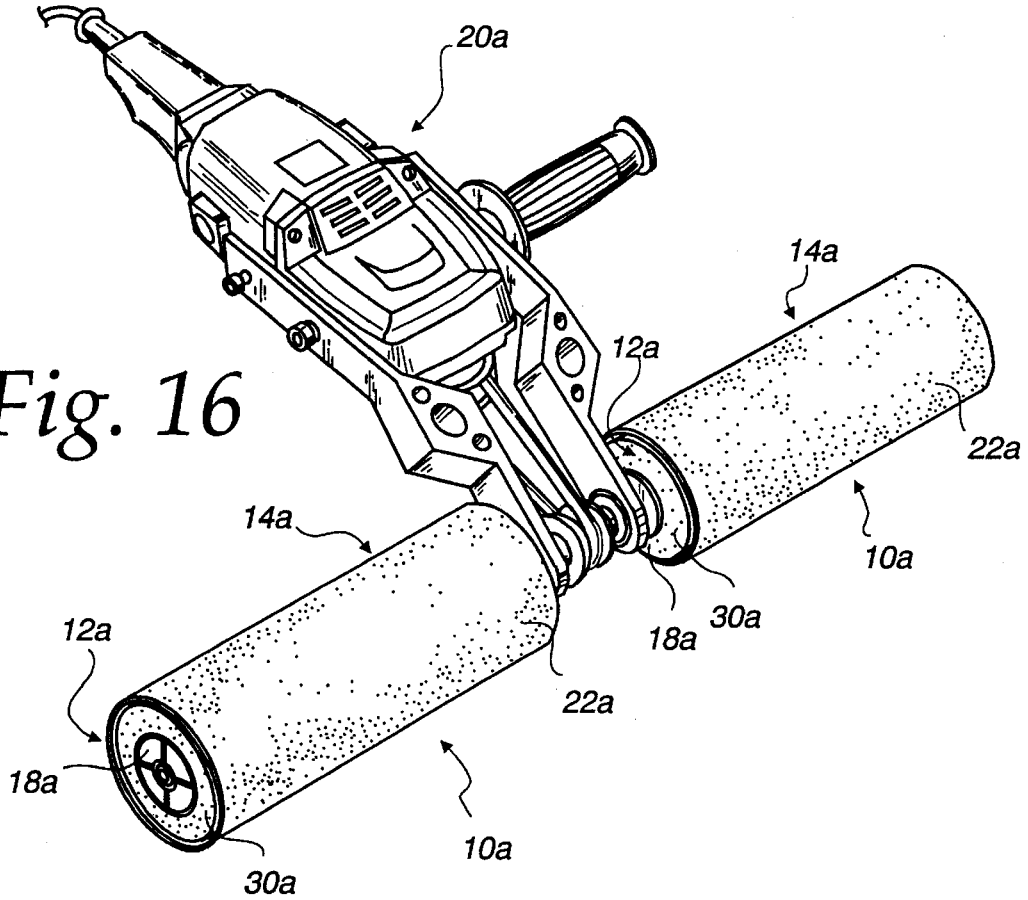
FIG. 16 is a perspective view of a roller and belt assembly, mounted on a roller-type sanding or buffing machine.

The cylindrical roller **12*a* includes an inner cylindrical tube 16*a*, having a smooth inner surface 17*a*. The inner surface 17*a* of the roller 12*a* allows the roller 12*a* to be mounted longitudinally on a rotating member 18*a* of a roller buffer machine 20*a* (FIG. 16**).

Figure 13:
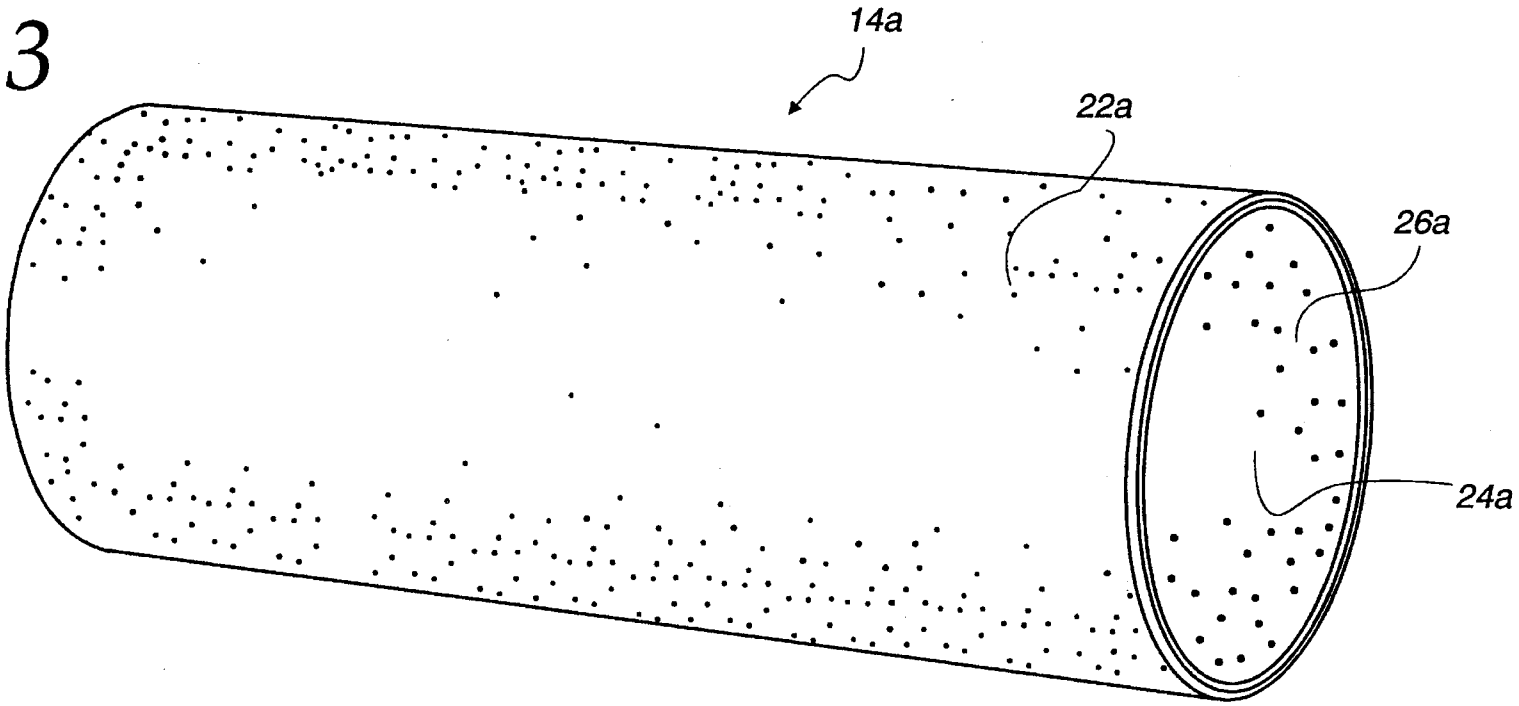
FIG. 13 is a perspective view of the closed loop sandpaper belt shown in FIG. 12.

Referring now to FIG. 13, the closed loop belt **14*a* has an outer surface 22*a* and an inner surface 24*a*. The outer surface 22*a* of the belt 14*a*, as illustrated, has sandpaper thereon. Note, however, that the outer surface 22*a* of the belt 14*a*** can have any suitable abrasive or buffing material thereon, e.g., a non-woven abrasive material such as one sold under the trademark SCOTCH-BRITE™ steel wool, cloth or foam material, which is used for finishing wood or any other sandable or buffable surface.

The inner surface **24*a* of the belt 14*a* has a coarse, looped material 26*a* thereon. The coarse, looped material 26*a*** can be a polyester material such as sewing fleece or a looped material similar to that used in a hook and loop type fastener assembly such as the assemblies sold under the trademark VELCRO™ or any other hook and loop assembly.

Figure 14:
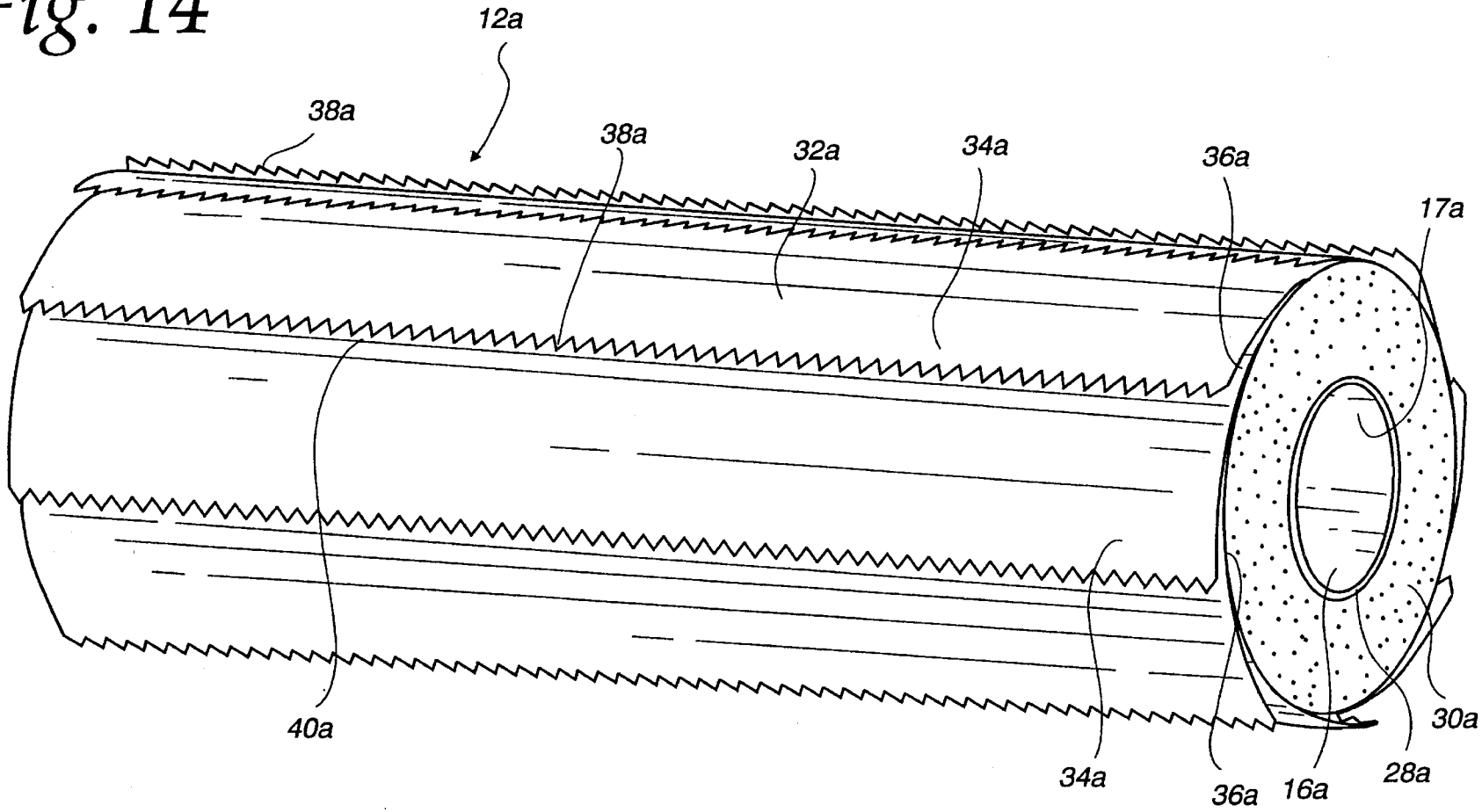
FIG. 14 is a perspective view of the roller shown in FIG. 12.
Figure 15:
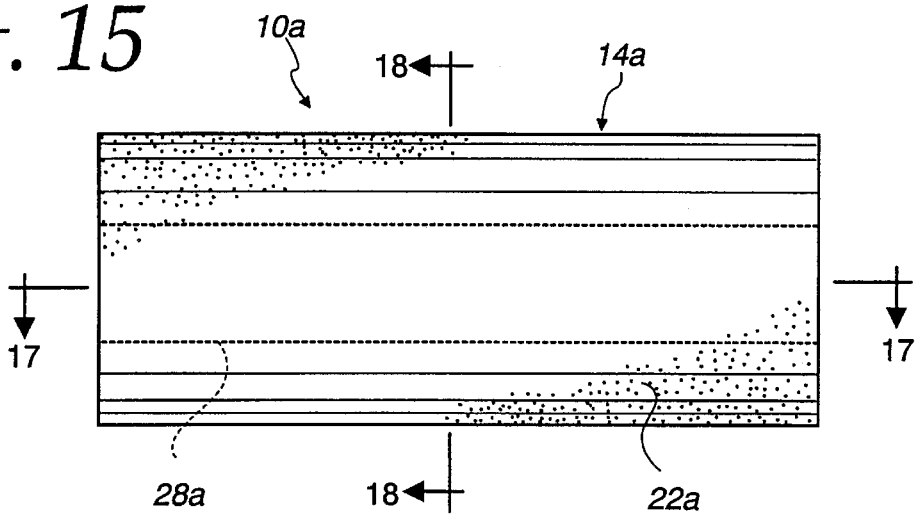
FIG. 15 is a front view of a roller fully inserted into a sandpaper belt to form an assembled roller and belt assembly.

The cylindrical tube **16*a*, shown in FIG. 14, is made of a rigid material, such as metal, plastic or cardboard so that the cylindrical tube 16*a* can be mounted to a rotating member 18*a* of a roller buffing machine (shown in FIG. 16**), a spindle sander (not shown) or a hand-held drill (not shown).

The cylindrical tube **16*a* has an outer surface 28*a* which has a compressible, resilient material 30*a* thereon. The compressible, resilient material 30*a* preferably is a foam material 30*a* and is attached to the outer surface 28*a* of the cylindrical tube 16*a* by an adhesive. The foam material 30*a* may also be extruded integrally with the tube 16*a***.

Figure 17:
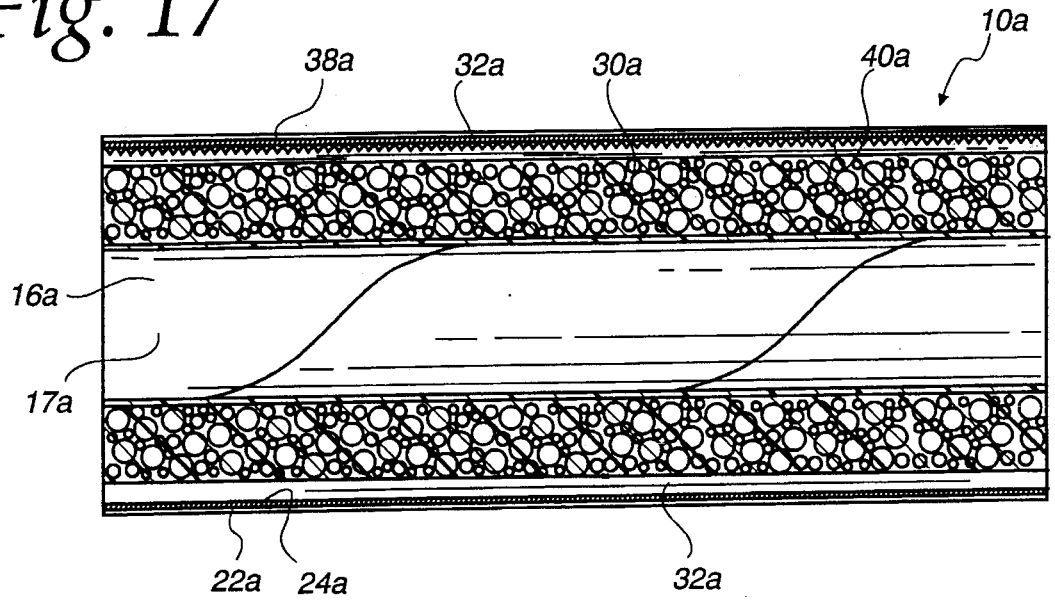
FIG. 17 is a longitudinal sectional view roller and belt assembly taken along the line 17—17 of FIG. 15.
Figure 18:
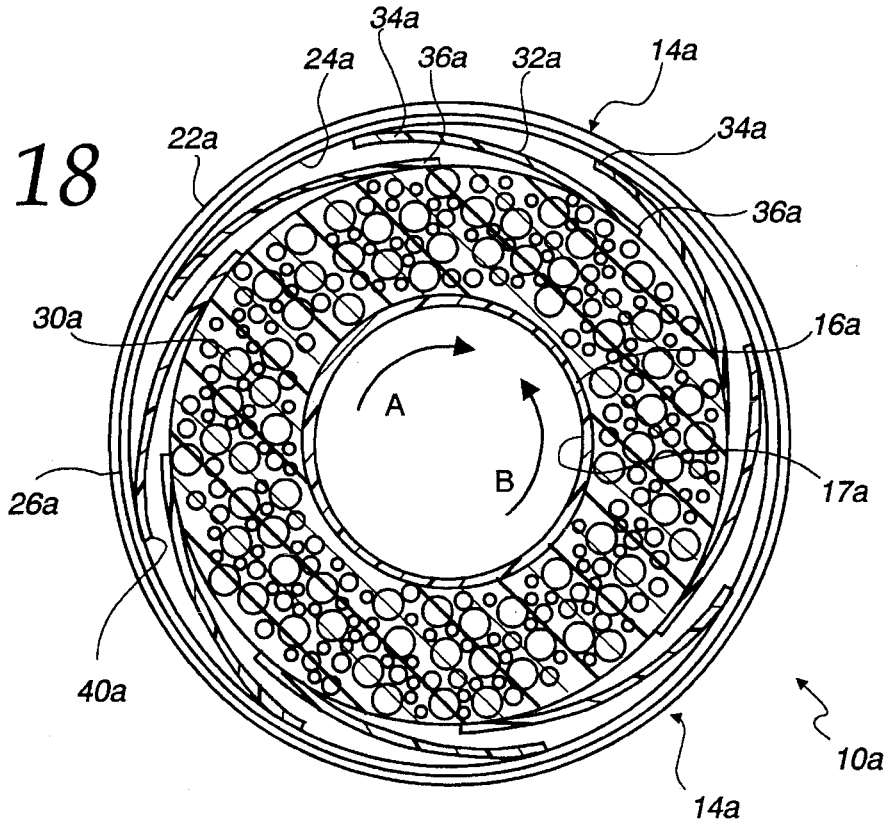
FIG. 18 is a cross-sectional view of the roller and belt assembly taken along the line 18—18 of FIG. 15.

As shown in FIGS. 14, 17 and 18, several flexible engagement strips **32*a*, preferably made of plastic, are attached to the foam material 30*a*. The engagement strips 32*a* have a front end or edge 34*a* and a back end or edge 36*a*. The back end 36*a* of each engagement strip 32*a* is attached to the foam material 30*a*** by an adhesives such as glue or tape.

The front end 34A of each engagement strip **32*a* is free, i.e., not attached to the foam material 30*a*. Additionally, the front end 34*a* of each engagement strip 32*a* is serrated to form teeth 38*a* which are cut into a front end edge 40*a* of the strip 32*a***.

As best shown in FIG. 18, the engagement strips **32*a* are flexible so that the strips 32*a* can be resiliently bent to conform to a circumference of the foam material 30*a* and the tube 16*a*. The attached strips 32*a* are preferably positioned on the foam material 30***a* so that when the strips 32*a* are bent to conform to the shape of the foam material 30*a* and tube 16*a*, the loose front end 34*a* of each engagement strip 32*a* overlaps the attached back end 36*a* of the engagement strip 32*a* just in front of it. Also, a sufficient number of engagement strips 32*a* are used so that when the foam material 30*a* is compressed, the engagement strips 32*a* completely cover the foam material 30*a* in the described overlapping manner.

The diameter of the uncompressed roller 12*a*, including the diameter of the tube 16*a*, the thickness of the uncompressed foam material 30*a* on the tube 16*a* and the thickness of the overlapped plastic strips 32*a* attached to the foam material 30*a* on the tube 16*a*, is slightly larger than an inner diameter of the belt 14*a*.

Therefore, in order to insert the roller 12 into the belt 14*a*, the foam material 30*a* of the roller 12*a* must be compressed; and the roller 12*a* must be simultaneously pushed into the belt 14*a* and rotated in a first direction, with respect to the belt 14*a*, as shown by an arrow A in FIGS. 12 and 18, such that the teeth 38*a* of the plastic strips 32*a* will not engage the looped material 26*a* on the inner surface 24*a* of the belt 14*a*. When the roller 12*a* is rotated in direction A, the plastic strips 32*a* of the roller 12*a* easily slide along the looped material 26*a* and the roller is easily inserted into the belt 14*a*. The direction of rotation of the roller 12*a* in the first direction A, as shown in FIG. 18, is clockwise with respect to the belt 14*a*.

Referring now to FIGS. 14, 17 and 18, once the roller 12*a* is inserted into the belt 14*a*, the foam material 30*a* and strips 32*a* are allowed to expand within the belt 14*a*. Although the foam material 30*a* expands to fit tightly within the belt 14*a*, the foam material 30*a* and plastic strips 32*a* are constrained by the belt 14*a* and cannot expand completely to their original shapes. Because the foam material 30*a* is still constrained by the continuous belt 14*a*, the foam material 30*a* applies an even, outwardly-directed, radial force against the inner surface 24*a* of the belt 14*a*.

As best illustrated in FIG. 18, when the roller 12*a* is inserted into the belt 14*a*, the teeth 38*a* of the bent plastic strips 32*a* all point in the same direction along the circumference of the roller 12*a* such that the teeth 38*a* will engage the looped material 26*a* if the roller 12*a* is rotated in a second directions B, as shown by an arrow in FIGS. 12 and 18. Note that the second direction, B, is opposite the first direction, A, and, as shown in FIG. 18, is in the counterclockwise direction with respect to the belt 14*a*.

When the roller 12*a* is completely inserted within the belt 14*a*, the roller 12*a* and belt 14*a* form an assembled roller and belt assembly 10*a* and, as previously described above, the assembled roller and belt assembly 10*a* can be attached to a rotating member 18*a* of a roller buffing machine (FIG. 16), a spindle sander or a hand-held drill.

When the roller and belt assembly 10*a* is used to sand or buff an object, the assembled roller and belt assembly 10*a* must be attached to the rotating member 18*a* so that the roller 12*a* will be driven or rotated in the second direction, B, to ensure that the teeth 38*a* will engage the looped material 26*a* and thereby rotate the belt 14*a* without causing the belt 14*a* to slip or creep off of the roller 12*a*.

After substantial use, a worn belt 14*a* can be removed from the roller 12*a* easily and replaced by a new belt 14*a*. The worn belt 14*a* is removed from the roller 12*a* by simultaneously rotating the roller 12*a* in the first directions A, so that the teeth 38*a* do not engage the looped material 26*a* and pushing the roller 12*a* out of the belt 14*a*. Then, a new belt 14*a* can be placed on the roller 12*a* in the same manner described above.

Figure 19:
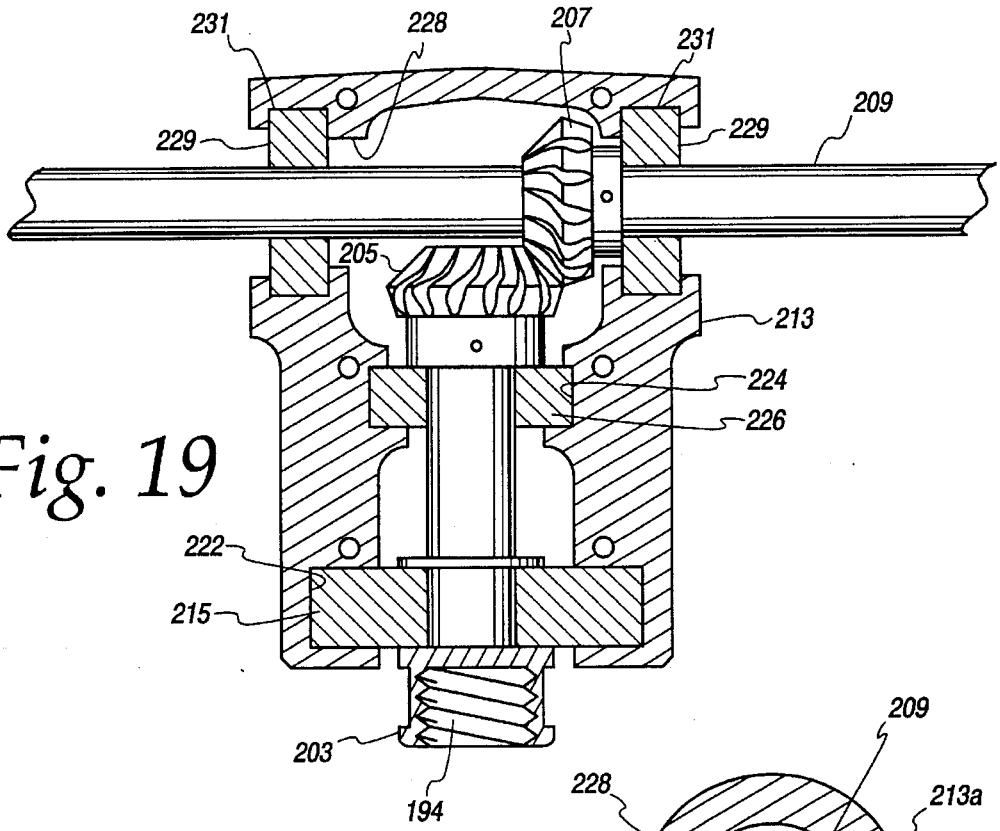
FIG. 19 is a cross-sectional view of a direct drive attachment for the sanding roller.
Figure 20:
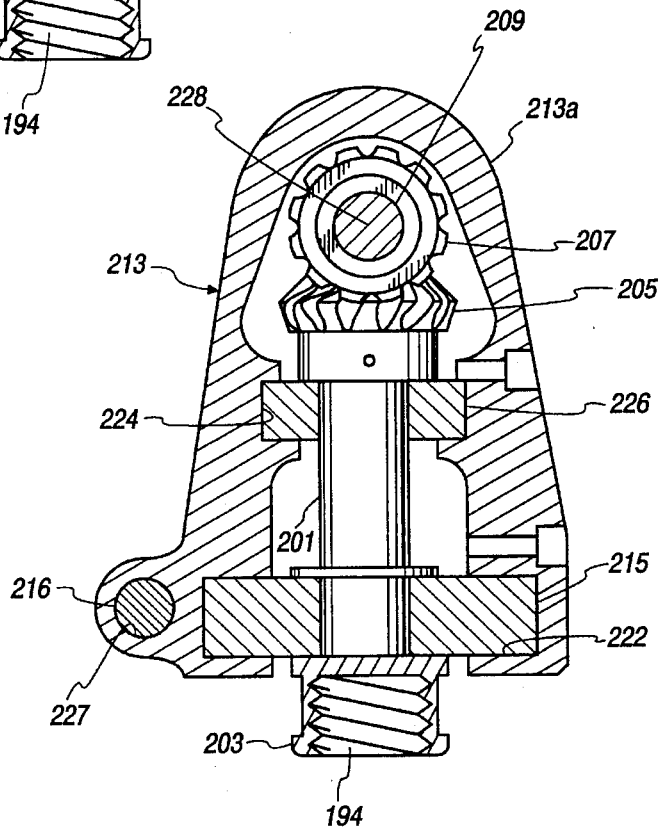
FIG. 20 is another cross-sectional view embodiment of the direct drive shown in FIG. 19.
Figure 21:
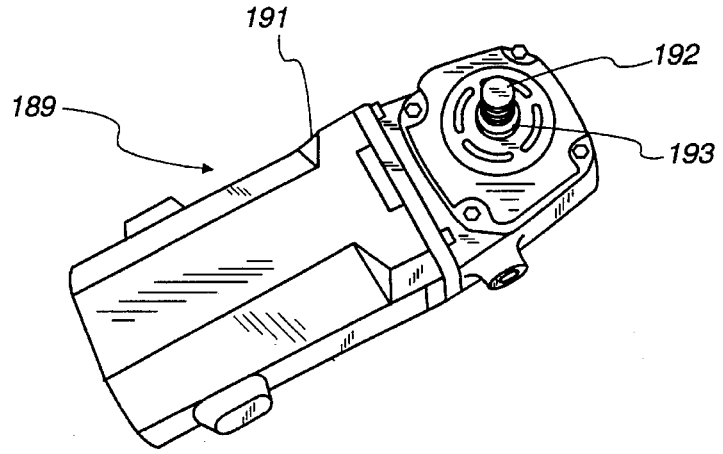
FIG. 21 is a perspective view of a motor unit without the sanding attachment.
Figure 21A:
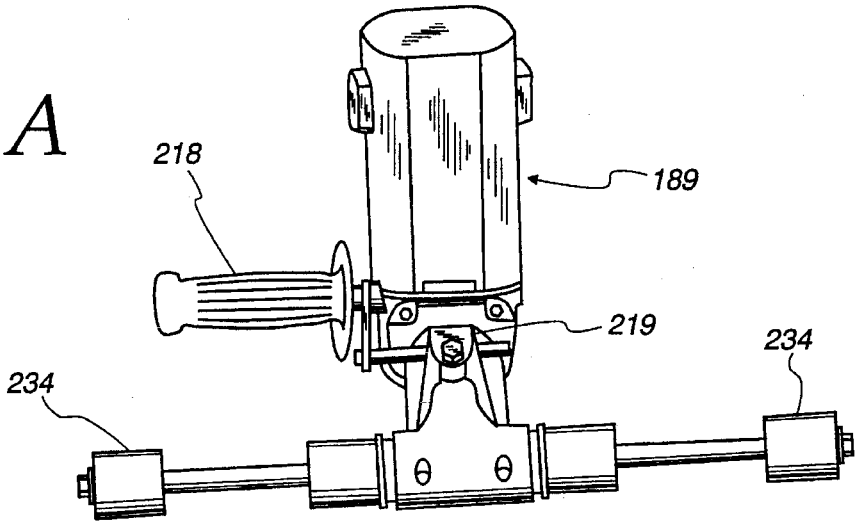
FIGS. 21A and 22 are perspective views of the sander attachment connected to the motor unit.
Figure 22:
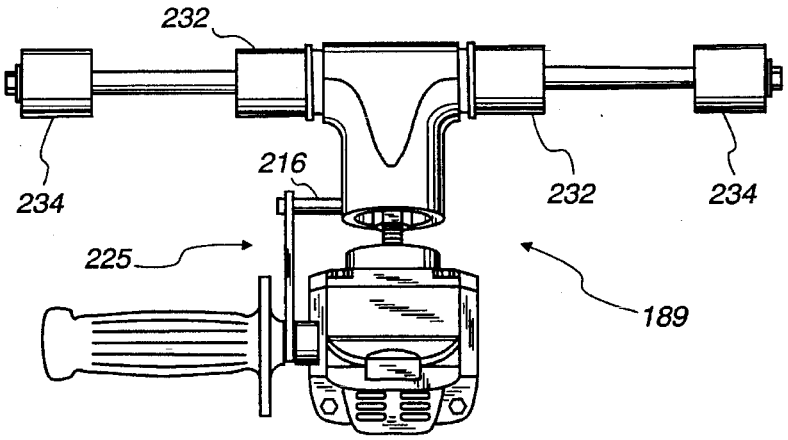

Rather than the belt drive disclosed in the embodiments of FIGS. 1–16, there is disclosed a direct drive relationship in the embodiment of FIGS. 17–23. A typical rotary sanding machine 189 is illustrated in FIGS. 21–22 as having a motor 191 for rotating a drive shaft 192 projecting at right angles from the motor body. The end of the motor drive shaft has an external screw thread 193 for connection to the sander attachment. The screw thread 193 is screwed into a threaded bore 194 of a shaft coupler 203 that is affixed to the lower end of a driven shaft 201, which extends within and rotates in the roller attachment assembly. The usual pad and rotating sander disk have been removed from the rotary sander leaving the screw thread 193 of the motor drive shaft exposed and onto which is then threaded the shaft coupler 203.

The motor drive shaft 192 thus may rotate the coupler 203 and the driven shaft 201 to rotate a drive gear 205 that is meshed with a driven gear 207 fixed to a rotatable roller shaft 209 extending horizontally for carrying and for rotating the sanding roller. The illustrated direct drive includes a pair of beveled, meshed drive and driven gears 205 and 207 that rotate about axes at a 90° angle to one another. The gear 205 is fixed to the upper end of the driven shaft 201 rotatably mounted in a frame or housing 213.

In this illustrated embodiment of the invention, preferably there is a cast housing 213, as illustrated in FIGS. 19 and 20, for carrying a lower bearing 215 for rotatably mounting the lower end of the driven shaft 201. The cast housing 213 (FIGS. 19 and 20) has a lower bearing seat 222 for holding the lower bearing 215 in which rotates the lower end of the driven shaft 201 and has an upper bearing seat 224 in which is seated an upper bearing 226 (FIG. 20) the upper portion of the driven shaft. An upper portion 213*a* of the cast housing 213 has a horizontal, cross bore 228 at the opposite ends of which are bearing seats 231 for roller shaft bearings 229. The bearings support the roller shaft 209 and the driven gear 207 for rotation about a horizontal axis through the center of the bearings 229 and the center axis of the horizontal cross bore 228.

To provide a simple and easy anti-rotation connection between the motor sander unit and the roller attachment, the latter is provided with an adjustable, anti-rotation brace 225 (FIG. 22) that will be connected between the attachment housing 213 and the motor unit. That is, the rotating motor shaft 192 turning the driven shaft 201 in the housing 213 exerts a torque that would rotate the housing and the rollers about the axis of the driven shaft if the housing 213 is not held stationary. To hold the housing stationary, the brace 225 has a first rod portion 216 (FIGS. 20 and 22) fixed to the housing 213; and the rod portion extends generally horizontal to a fixed slotted, plate portion 217, which is connected to the motor unit at a handle 218. The rod portion 216 is inserted into a horizontal bore 227 on the exterior portion of the housing. A clamping screw 219 is threaded in the housing at the bore 227 and may be tightened to clamp the rod portion at given amount of insertion into the bore and at a given amount of angular rotation in the bore. The plate portion 217 of the brace has an elongated central slot 228 to receive the threaded end of the handle. The slot is aligned with the threaded hole in the motor, and the threaded end of the handle is inserted through the slot and threaded into the motor. Thus, the handle 218 holds the plate portion against turning, and the attachment holds the housing 213 against rotating about the axis of the driven shaft 201 as it is rotated by the motor.

The preferred manner of attaching a sanding roller to the rotatable roller shaft 209 is by providing a pair of spaced bushings 232 and 234 (FIG. 22) mounted on and secured to the roller shaft 209 at axially spaced locations. The first bushing 232 is mounted inwardly adjacent the cast housing 213 and has a flange 238 on one end against which abuts the inner end wall of the sanding roller to limit the extent of roller insertion on the shaft. The bushing has an outer diameter surface sized to the internal bore diameter of the roller.

Figure 24:
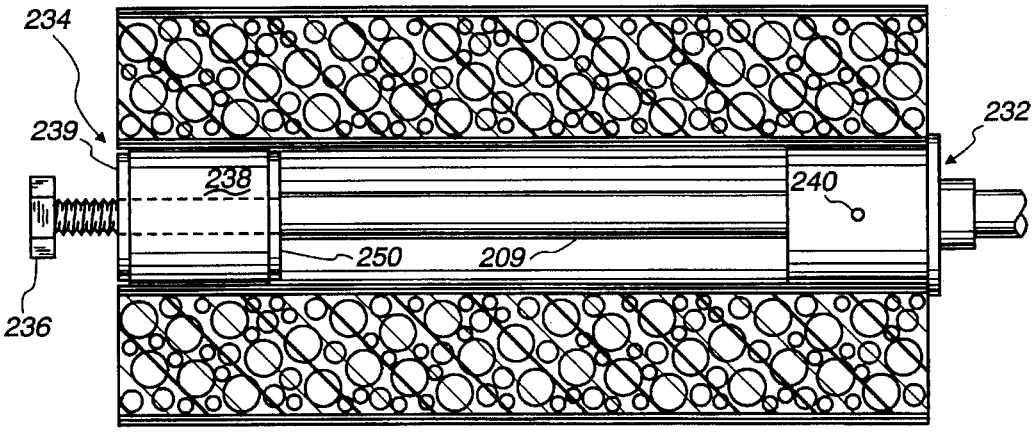
FIG. 24 is a view of one-half of the roller shaft prior to receiving a roller.

At the outer ends of the shaft 209 are the second expandable bushings 234 (FIG. 24) which are cylinders made with an expandable body 238 of elastomeric material with a good coefficient of friction. After sliding the roller on the first and second bushings 232 and 234, an outer nut 236 is turned on a threaded end portion of the shaft toward a pair of metal disks 239 and 250. The disk 250 is fixed to the roller shaft and the disk 239 slides on the shaft. The nut 239 is turned on the threaded end 237 of the shaft to abut the adjacent metal disk 239 and forces it to the right, so that the bushing body 238 is compressed between the disks 239 and 250. The outer bushing body 238 expands in diameter to come into intimate tight engagement with the bore defining wall in the roller. This provides a releasable, non-slip drive between outer bushing and a roller thereon. When it is desired to remove a sanding roller, the nut 236 is turned to travel outwardly in the direction of the free end of the roller shaft, thereby removing the compressing force on the elastomeric body 238 allowing it to contract and to decrease its diameter. This allows the roller to be slid from the bushings 232 and 234 for removal.

The inner bushings 232 each have a radially-directed set screw 240 (FIG. 24) threaded into the body of the bushing 232 with the inner end of the set screw engageable with the roller shaft 209. The set screws may be loosened to allow the bushings 232 to be slid longitudinally along the roller shaft. After being positioned on the roller shaft at the desired locations, the outer ends of the set screws are engaged with a tool and turned to drive their inner ends tightly against the roller shaft. In this manner, the inner bushings are secured to the shaft at positions for length of sanding roller being slid upon the bushings 232 and 234 (FIG. 22). The preferred, soft layer backing for the sanding layer or sheet is a soft material, such as a sponge or foam rubber or plastic, that has pores. The illustrated soft foam rubber or plastic layer is the type of foam that is used for painting with a roller. That is, a foam paint roller is mounted on the bushings 232 and 234; and the outer surface of the paint roller is compressed radially inwardly by the sanding sleeve when it is telescoped over the foam paint roller. The compressed foam applies radially outwardly-directed forces to the sanding sleeve. It will be recognized that the sanding layer or sleeve could be permanently attached or bonded to the outer face of a foam layer; and that this composite of foam and sanding sleeve could be attached to the driving axle 209 to provide the rotatable sanding roller.

Figure 23:
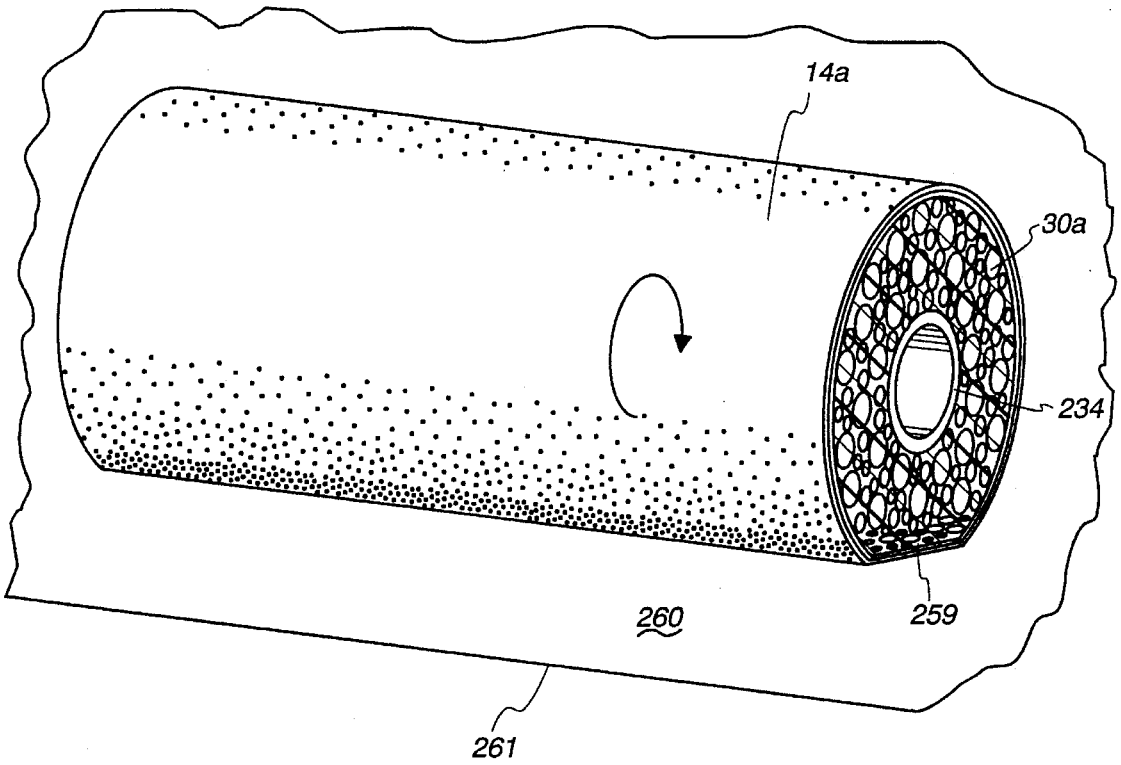
FIG. 23 shows the flat wide area of contact between the sanding layer and the wooden surface and compression of the soft, compliant, backing layer.

In use, the operator pushes the sanding layer against a surface; and the sanding roller has a wide flat area 259 formed on the bottom thereof, as shown in FIGS. 23, where the sanding roller engages a wood surface 260 on a wood sheet 261. For the three-inch diameter sanding sleeve described herein, the flattened area 259 is about 1.75 inches in width and extends the full nine inches along the length of the roller. The width of the flat area 259 may vary considerably from the 1.75 inch width that was measured in the illustrated embodiment of the invention and described herein when a typical force was applied while sanding. If the user pushes with less force, the flat area 259 may be smaller than 1.75 inch for the same roller. Manifestly, by changing the softness of the foam rubber or other materials, the width of the flat area 259 can be varied substantially from 1.75 inches and still fall within the purview of the invention. For example, the flat area may range from about ¼ inch in width to greater than 1.75 inch in width. Hard rubber or elastomeric materials will not provide the substantial flat area and will chatter when moved along the surface during sanding. This wide flat area 259 provides a large sanding area that a mere line contact with the wood as when there is not a soft compliant layer under the sanding sheet. The soft compliant layer quickly expands the sanding layer outwardly into the cylindrical surface as the previously flattened surfaces travel upwardly in a clockwise direction from the wood surface. Of course, the downwardly moving curved area on the roller adjacent the wood flattens as it engages the wood. Because of the soft, compliant, backing layer, the sanding layer rides softly on the top of the wood and travels over low or high spots without digging in or chattering, as will prior art sanding rollers.

What is claimed is:

1. A hand-held, abrasive roller apparatus for linear abrasive movement across a substrate surface comprising:

a frame;

a motor supported on the frame;

a cylindrical sanding roller mounted on the frame and driven by the motor to rotate about a central, longitudinal, rotational axis through the sanding roller;

a cylindrical sleeve having a bore of a first diameter and an outer sanding surface layer, the sanding sleeve being deflectable to provide a flat on a side engaging and sanding a substrate underlying surface and for traveling linearly along the substrate surface;

a soft, deformable backing layer on the sanding roller having a first cylindrical shape to hold the sanding surface sheet in a cylindrical shape prior to sanding and deformable into a second shape with a substantial flat on said backing layer to support the flat on the sanding surface sheet as the frame is pushed linearly and the sanding roller travels linearly along the substrate surface; said soft, deformable, backing layer on the roller having an uncompressed diameter larger than the first diameter with the sleeve;

the backing layer being compressed by the sleeve and exerting radially, outwardly, directed forces on the sanding sleeve of substantially constant force; and the soft, deformable, compressed backing layer providing a larger sanding area than a straight line of contact, and traveling over low and high spots without digging in or chattering.

2. A hand-held sanding roller apparatus in accordance with claim 1 wherein the backing layer is a material having pores.

3. A sanding apparatus in accordance with claim 1 wherein the backing layer is foam rubber or plastic and has a radial thickness several times the radial thickness of the sanding surface layer.

4. A sanding apparatus in accordance with claim 1 wherein one way clutch means is provided between the deformable, backing layer and the sanding sleeve and allows the sanding sleeve to slide and turn relative to deformable, backing layer in a first direction when attaching or detaching the sanding sleeve and prevents this turning relative to the deformable, backing layer during a sanding operation.

5. A sanding apparatus in accordance with claim 4 wherein the sleeve has a hollow bore of a first diameter and the deformable, backing layer is a foam layer having pores with a relaxed outer diameter greater than the first diameter so that the compressed foam layer provides a uniform, outwardly directed force on the sanding sleeve.

6. A hand-held, abrasive roller apparatus for linear abrasive movement across a substrate surface comprising:

a frame;

a motor supported on the frame;

a cylindrical sanding roller mounted on the frame and driven by the motor to rotate about a central, longitudinal, rotational axis through the sanding roller;

an outer sanding sleeve having a bore of a first diameter detachably mounted on the roller deflectable to provide a flat on a side of the roller which is engaging and sanding an underlying surface and for traveling linearly along the surface;

a soft, deformable backing layer on the sanding roller having an uncompressed diameter larger than the bore diameter of sleeve, the backing layer being compressed by the sleeve with the compressed backing layer exerting even outwardly directed forces to hold the sanding sleeve in a cylindrical shape prior to sanding and deformable into a second shape with a substantial flat on the bottom thereof to support the flat on the bottom of the sanding surface sheet with a soft, deformable backing as the frame is pushed linearly and the sanding roller travels linearly along the surface; and a one-way connection means between the sanding sleeve and the compressed backing layer allowing relative turning therebetween despite the outwardly directed forces applied by the compressed backing layer against the one-way connection when applying the sleeve to the roller in a first direction, the one-way connection preventing relative turning between the sleeve and the roller in the opposite direction while sanding.

* * * * *